US008770806B2

(12) United States Patent
Koo et al.

(10) Patent No.: US 8,770,806 B2
(45) Date of Patent: Jul. 8, 2014

(54) LIGHT EMITTING DIODE LIGHTING MODULE

(71) Applicant: Samsung Electronics Co., Ltd., Suwon-si (KR)

(72) Inventors: Won-Hoe Koo, Seoul (KR); Chul Park, Hwaseong-si (KR); Yun Seok Woo, Suwon-si (KR); Il Seok Lee, Seoul (KR); Dong Il Lim, Uijeongbu-si (KR); Deok Hee Hee Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/645,056

(22) Filed: Oct. 4, 2012

(65) Prior Publication Data

US 2013/0083525 A1 Apr. 4, 2013

(30) Foreign Application Priority Data

Oct. 4, 2011 (KR) ..... 10-2011-0100721

(51) Int. Cl.
*F21V 21/00* (2006.01)

(52) U.S. Cl.
USPC ..... 362/374; 362/246; 362/247; 362/651

(58) Field of Classification Search
USPC ..... 362/242, 243, 244, 245, 246, 247, 362/249.02, 311.01, 311.02, 368, 374, 375, 362/640, 649, 651
See application file for complete search history.

(56) References Cited

U.S. PATENT DOCUMENTS

| | | | | |
|---|---|---|---|---|
| 5,465,199 | A * | 11/1995 | Bray et al. | 362/374 |
| 2009/0103296 | A1 * | 4/2009 | Harbers et al. | 362/249.02 |
| 2010/0208473 | A1 | 8/2010 | Sakai et al. | |
| 2012/0236563 | A1 * | 9/2012 | Breidenassel et al. | 362/249.02 |

FOREIGN PATENT DOCUMENTS

| | | | |
|---|---|---|---|
| JP | 2002-304903 | A | 10/2002 |
| JP | 2003-068111 | A | 3/2003 |
| JP | 2008-059862 | A | 3/2008 |
| JP | 2010-157376 | A | 7/2010 |
| KR | 10-2010-0120852 | A | 11/2010 |
| WO | WO 2011067093 | A1 * | 6/2011 |

* cited by examiner

*Primary Examiner* — Y My Quach Lee
(74) *Attorney, Agent, or Firm* — Sughrue Mion, PLLC

(57) ABSTRACT

A light emitting diode (LED) lighting module is provided including an LED array, and at least one of a diffusing portion and a reflecting portion. The LED array, equipped with at least one LED, may include a side wall which surrounds the at least one LED. The diffusing portion may be detachably coupled to the LED array and may include a diffusion plate which diffuses light emitted from the at least one LED The reflecting portion may be detachably coupled to one of the LED array and the diffusing portion and may reflect light emitted from the at least one LED. The LED array may be selectively coupled with the diffusing portion, the reflecting portion, or both the diffusing portion and the reflecting portion.

20 Claims, 11 Drawing Sheets

LIGHT EMITTING DIODE LIGHTING MODULE

CROSS-REFERENCE TO RELATED APPLICATION

This application claims priority from Korean Patent Application No. 10-2011-0100721, filed on Oct. 4, 2011, in the Korean Intellectual Property Office, the disclosure of which is incorporated herein by reference.

BACKGROUND

1. Field

Apparatuses consistent with exemplary embodiments relate to a light emitting diode (LED) lighting module, and more particularly, to an LED lighting module that is selectively coupled with a diffusing portion, which diffuses light emitted from an LED array, or a reflecting portion which reflects light.

2. Description of the Related Art

A light emitting diode (LED) refers to a semiconductor device that emits a light when a current flows, and refers to an electronic component that is a PN junction diode, and may include a gallium arsenide (GaAs) and a gallium nitride (GaN) optical semiconductor, and transforms electric energy to light energy.

Recently, blue LEDs and ultraviolet light LEDs, embodied using a nitride having superior physical and chemical characteristics, have been developed, and the scope of applications for LEDs has expanded because white light or monochromatic light can be generated using a blue LED or an ultraviolet LED and a fluorescent substance.

An LED may have features including a long lifespan, a small size, and a light weight, and may operate with a low voltage because an LED has a strong directivity. Also, LEDs are robust with respect to impact and vibration, do not require warm-up time, and are easily operated. Thus, LEDs may be utilized for any of a number of uses. For example, the scope of applications for LEDs has been expanded to include the small lighting of a mobile terminal, indoor illumination, outdoor illumination, courtesy lights in a car, and backlights of large liquid crystal displays (LCDs), and the like.

A brightness or a distribution angle of light emitted from the LED may be adjusted by a diffusing portion that diffuses a light or by a reflecting portion that reflects light.

Accordingly, there is a desire for a lighting module that has a simple structure for coupling the diffusing portion or the reflecting portion with a basic array equipped with an LED.

SUMMARY

One or more exemplary embodiments may provide a light emitting diode (LED) lighting module including an LED array that may be selectively coupled with a diffusing portion diffusing light emitted from the LED array including LEDs, or with a reflecting portion and thus, a brightness or a distribution angle of a light may be appropriately adjusted.

One or more exemplary embodiments may provide an LED lighting module that may have a simple structure for coupling an LED array with a diffusing portion or a reflecting portion and thus, fastening and replacement may be readily performed.

One or more exemplary embodiments may provide an LED lighting module in which an LED array is formed to be integrated with a diffusing portion, and a reflecting portion reflecting a light may be readily coupled with the LED array.

According to an aspect of an exemplary embodiment, there is provided n LED lighting module, including an LED array, and at least one of a diffusing portion and a reflecting portion, and the LED array, equipped with at least one LED, includes a side wall which surrounds the at least one LED, the diffusing portion, detachably coupled with the LED array, includes a diffusion plate to diffuse light emitted from the at least one LED, and the reflecting portion, detachably coupled with one of the LED array and the diffusing portion, reflects light emitted from the at least one LED.

A plurality of first protrusions, laterally protruding, may be disposed on an external surface of the side wall, and a plurality of first insertion members, to which the plurality of first protrusions are partially insertable for coupling, may be disposed on a side wall of the diffusing portion corresponding to the plurality of first protrusions, so that the LED array and the diffusing portion may be detachably coupled to each other.

The first insertion member may be cut from a lower portion of the side wall of the diffusing portion in an upward direction, and then cut in a lateral direction, so that the first protrusion may be inserted into the first insertion member for coupling.

The plurality of first protrusions may be disposed at predetermined intervals around a circumference of the side wall, and the plurality of first insertion members may be disposed on the side wall of the diffusing portion at predetermined intervals so as to correspond to locations of the plurality of first protrusions.

A plurality of second protrusions, protruding laterally, may be disposed on an external surface of the diffusing portion, and a plurality of second insertion members, into which the plurality of first protrusions or the plurality of second protrusions are partially insertable for coupling, may be disposed on a side wall of the reflecting portion corresponding to the plurality of first protrusions or the plurality of second protrusions.

The second insertion member may be cut from a lower portion of the side wall of the reflecting portion in an upward direction, and then cut in a lateral direction, so that the first protrusion or second protrusion may be inserted into the second insertion member.

A bending portion of the cut portion of the first insertion member may be rounded to enable the first protrusion to readily enter and leave.

A bending portion of the cut portion of the second insertion member may be rounded to enable the first protrusion or the second protrusion to readily enter and leave.

A stopper may protrude from an internal side of the first insertion member, so as to prevent the first protrusion from arbitrarily leaving the first insertion member.

A stopper may protrude from an internal side of the second insertion member, so as to prevent the first protrusion or the second protrusion from arbitrarily leaving the second insertion member.

The first insertion member may be a long slot that is formed on the diffusing portion in a lateral direction, and may include a stopper protruding from an internal end portion of the first insertion member to prevent the first protrusion from arbitrarily leaving the first insertion member, and the second insertion member may be a long slot that is formed on the reflecting portion in a lateral direction, and may include a stopper protruding from an internal end portion of the second insertion member to prevent the first protrusion or the second protrusion from arbitrarily leaving the second insertion member.

The diffusing portion may be detachably coupled to a diffusing sheet selected from a plurality of diffusing sheets, so as to adjust a distribution angle of a light emitted from the at least one LED.

The diffusing portion may include a diffusing body detachably coupled to the LED array, and a sheet fixing cap that holds the diffusing sheet to an upper portion of the diffusing body, and is detachably coupled to the diffusing body.

The diffusing sheet may be a lens, a micro pattern may be formed on at least one surface of the diffusing sheet, and the diffusing sheet may be formed of a resin material filled with a diffusion material and a fluorescent substance.

According to an aspect of another exemplary embodiment, there is provided an LED lighting module, including an LED array, equipped with a plurality of LEDs, integrated with a diffusing portion to diffuse light emitted from the plurality of LEDs, and a reflecting portion, detachably coupled with the LED array, reflecting light emitted from the plurality of LEDs.

The LED array may include a mounting plate on which the plurality of LEDs are mounted at regular intervals, and a sheet fixing member detachably coupled to the mounting plate, so as to hold, to the mounting plate, the diffusing portion that is detachably coupled to an opening that opens in one direction.

A plurality of protrusions, protruding to a lateral direction, may be disposed on an external surface of a side wall, and a plurality of insertion members, into which the plurality of protrusions is partially insertable for coupling, may be disposed on a side wall of the reflecting portion corresponding to the plurality of protrusions, so that the LED array and the reflecting portion are detachably coupled to each other.

The insertion member may be cut from a lower portion of the side wall of the reflecting portion in an upward direction, and then cut in a lateral direction, or the insertion member may be a long slot that is formed along a lateral direction of the side wall of the reflecting portion.

A stopper may protrude from an internal side of the insertion member, so as to prevent the protrusion coupled with the insertion member from arbitrarily leaving the insertion member.

The diffusing portion may be a lens-type diffusing sheet, and the reflecting portion may have a trim structure.

Additional aspects, features, and/or advantages will be set forth in part in the description which follows and, in part, will be apparent from the description, or may be learned by practice of the exemplary embodiments.

One or more exemplary embodiments may provide a light emitting diode (LED) lighting module including an LED array that is selectively coupled with a diffusing portion for diffusing a light emitted from the LED array including LEDs, or with a reflecting portion for reflecting a light and thus, a brightness or a distribution angle of a light may be appropriately adjusted.

One or more exemplary embodiments may provide an LED lighting module that may have a simple structure for coupling an LED array with a diffusing portion or a reflecting portion and thus, fastening and replacement may be readily performed.

One or more exemplary embodiments may provide an LED lighting module in which an LED array is formed to be integrated with a diffusing portion, and a reflecting portion reflecting a light may be readily coupled with the LED array.

BRIEF DESCRIPTION OF THE DRAWINGS

These and/or other exemplary aspects, features, and advantages will become apparent and more readily appreciated from the following description of exemplary embodiments, taken in conjunction with the accompanying drawings in which.

DETAILED DESCRIPTION

Figure 1:
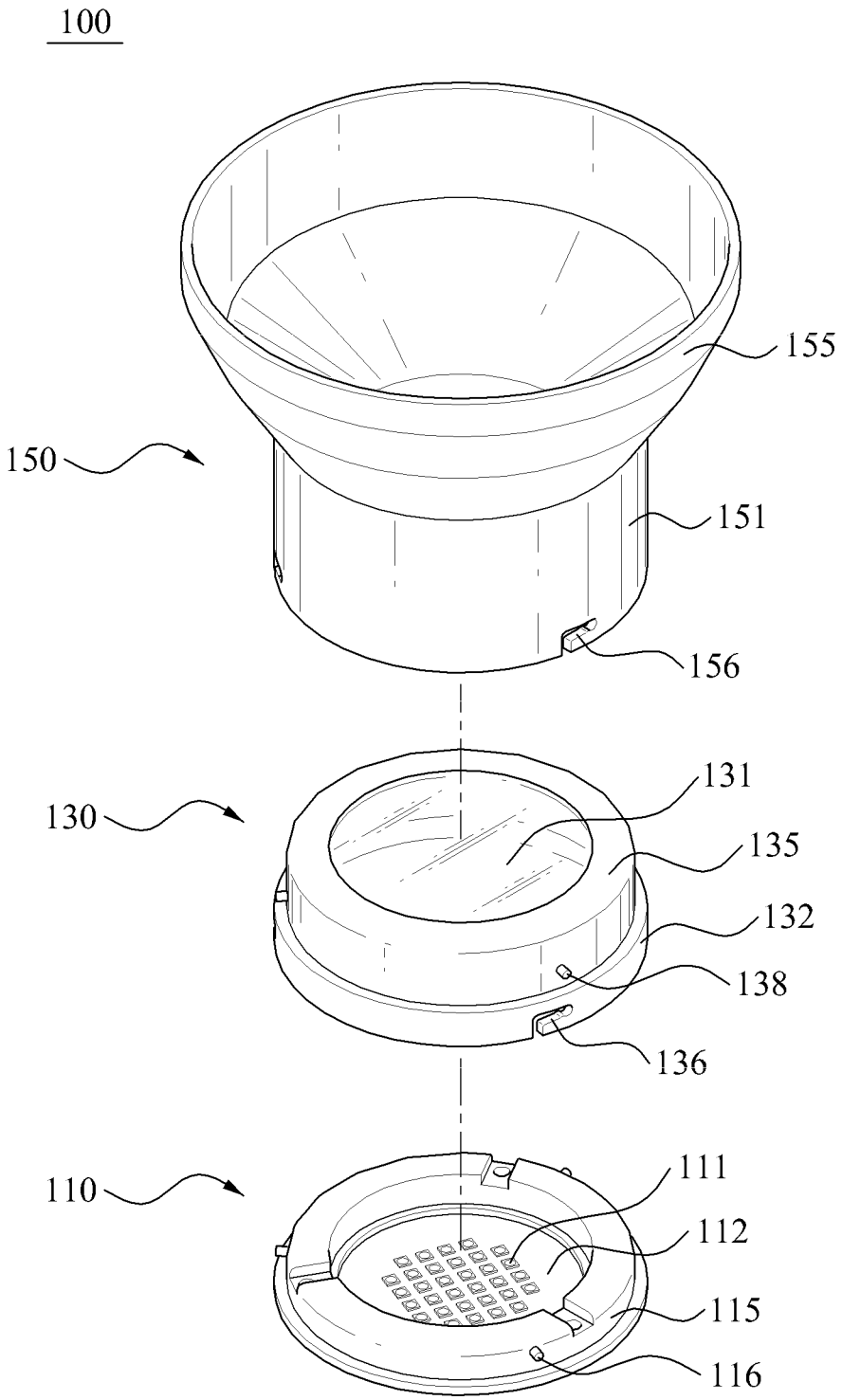
FIG. 1 is an exploded perspective view of a light emitting diode (LED) lighting module according to an exemplary embodiment.

Reference will now be made in detail to exemplary embodiments, which are illustrated in the accompanying drawings, wherein like reference numerals refer to the like elements throughout.

Figure 2:
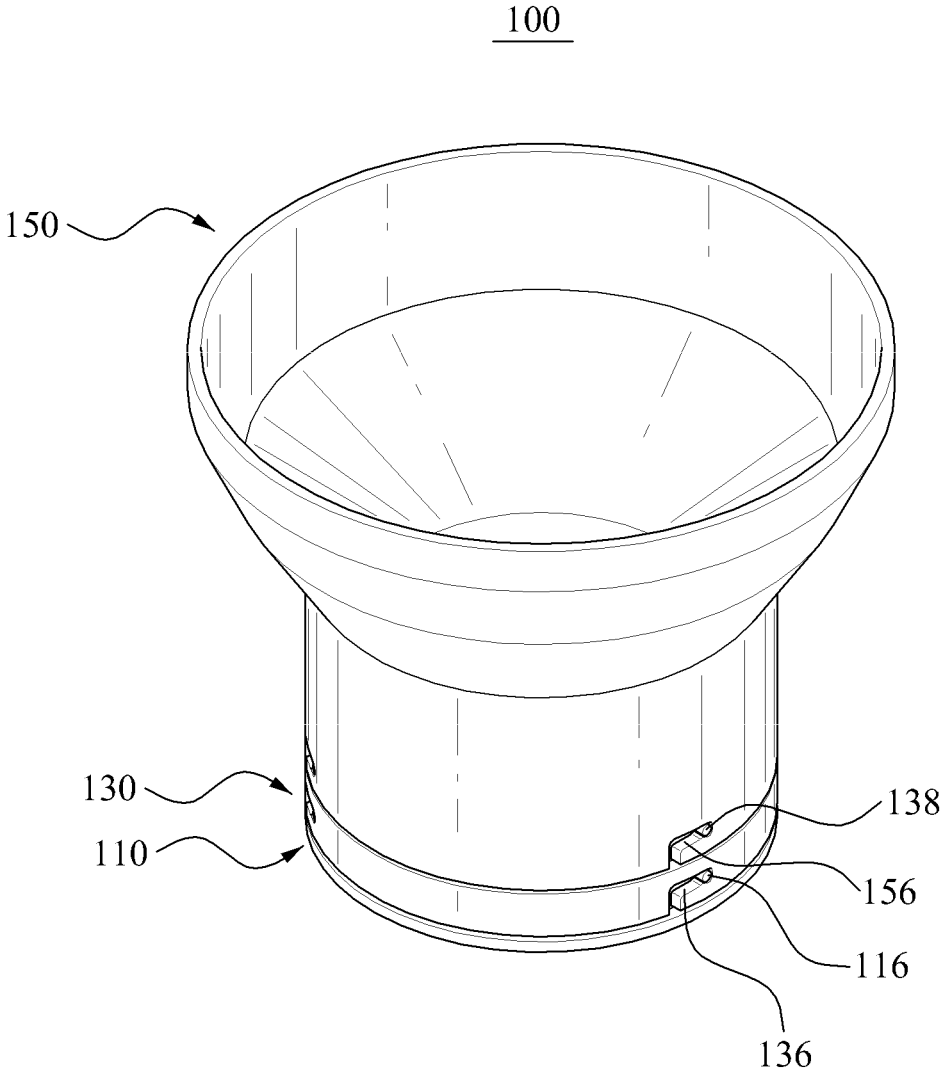
FIG. 2 is a perspective view of the LED lighting module of FIG. 1.
Figure 3:
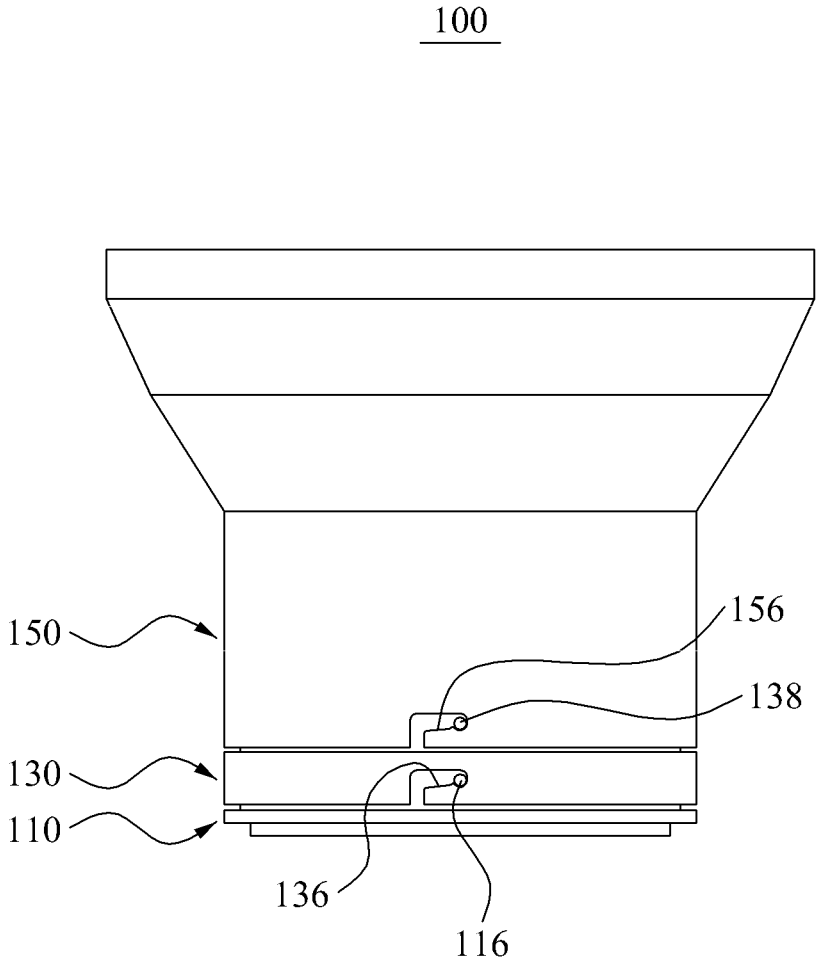
FIG. 3 is a front view of the LED lighting module of FIG. 2.
Figure 4:
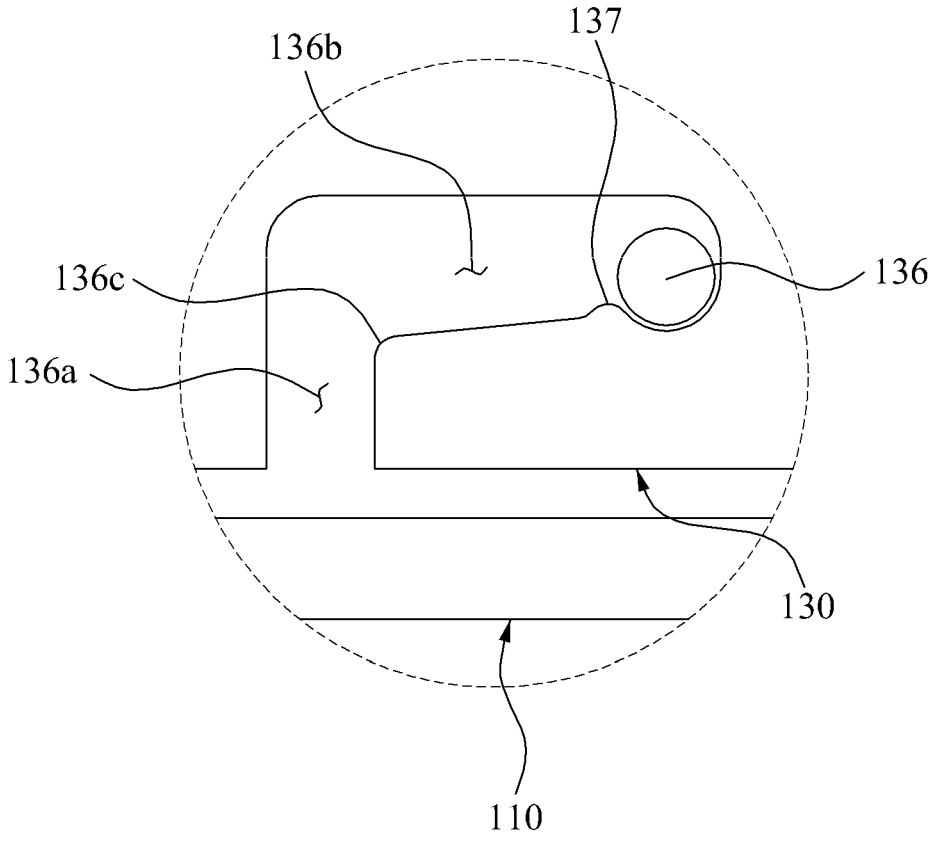
FIG. 4 is a magnified view of a portion of the LED lighting module of FIG. 3.
Figure 5:
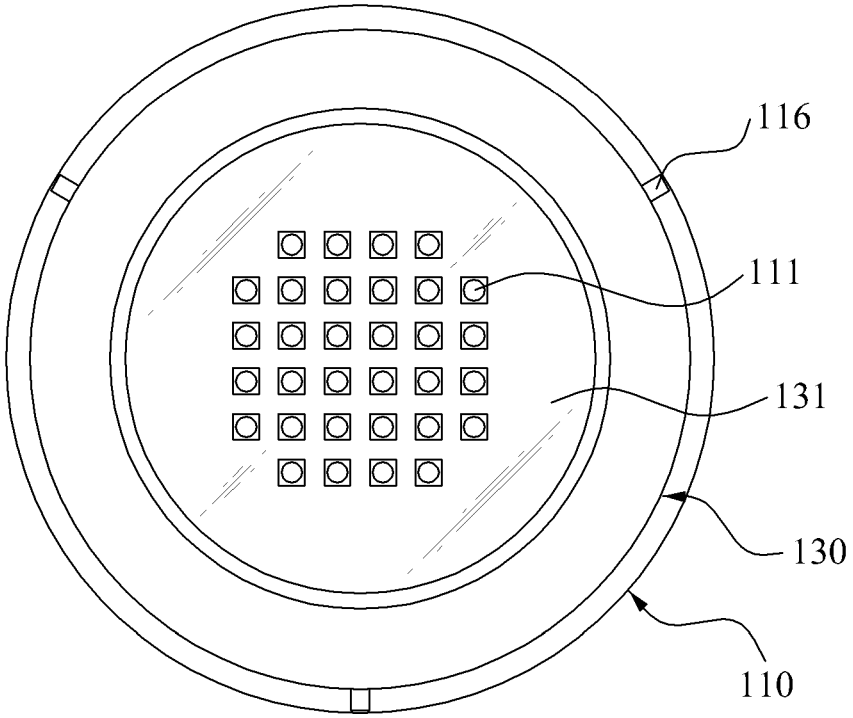
FIG. 5 is a top view of a configuration of the LED lighting module, excluding a reflecting portion, of FIG. 3.

FIG. 1 illustrates an exploded perspective view of a light emitting diode (LED) lighting module 100 according to an exemplary embodiment. FIG. 2 illustrates a perspective view of the LED lighting module 100 of FIG. 1. FIG. 3 illustrates a front view of the LED lighting module 100 of FIG. 2. FIG. 4 illustrates a magnified drawing of a portion of the LED lighting module 100 of FIG. 3. FIG. 5 illustrates a top view of a configuration of the LED lighting module of FIG. 3 excluding a reflecting portion.

Referring to FIGS. 1 and 2, the LED lighting module 100 includes an LED array 110, a diffusing portion 130, and a reflecting portion 150. The LED array 110, equipped with a plurality of LEDs 111, may include a side wall 115 to enclose the plurality of LEDs 111. The diffusing portion 130 is detachably coupled with the LED array 110, and may include a diffusion plate 131 for diffusing a light emitted from the LEDs 111. The reflecting portion 150 is detachably coupled with the diffusing portion 130, and may include a reflecting portion 150 for reflecting a light emitted form the LEDs 111.

Accordingly, light emitted from the LEDs 111 may be diffused by the diffusing portion 130 and may be reflected by the reflecting portion 150 so as to provide light.

Herein, each element of the LED lighting module will be described.

The LED array 110 may include a mounting plate 112 to which the LEDs 111 are coupled at regular intervals, so that the array of LEDs has a predetermined shape, and a side wall 115, coupled to the mounting plate 112, along the periphery of an upper portion of the mounting plate 112 so as to enclose the plurality of LEDs 111.

The plurality of LEDs 111 may emit light when the LEDs 111 are connected with a printed circuit board (PCB) (not illustrated) on the mounting plate 112 and are provided with a current. Although a plurality of LEDs 111 is described herein, as illustrated in the drawings, the LED array 110 may include a single LED when the single LED provides the amount of light desired. Each LED 111 may include a first type semiconductor layer, an active layer, and a second type semiconductor layer, and may emit light by performing recombination between an electron and a hole when a voltage is provided.

The LED array 110 configured as described in the foregoing may be utilized as a single product. For example, the LED array 110 may be utilized as a lighting engine, for example, a local lighting engine, since the LED array 110 may have a structure that provides a satisfactory quality of light.

The diffusing portion 130 may be detachable from the LED array 110, as opposed to being integrated with the LED array 110 and thus, the LED lighting module 110 may be utilized in varied combinations.

The diffusing portion 130 may diffuse and mix light emitted from the LEDs 111 of the LED array 110 so as to reduce an artifact occurring in the LED array 110 in which the LEDs 111 are disposed.

As illustrated in FIG. 1, the diffusing portion 130 may include the diffusion plate 131, also referred to as a diffusing sheet 131 in the present embodiment, a diffusing body 132 which is detachably coupled with the side portion wall 115 of the LED array 110, and a sheet fixing cap 135, which is detachably coupled with the diffusing body 132, fixing the diffusing sheet 131 to an upper portion of the diffusing body 132.

The sheet fixing cap 135 and the diffusing body 132 may be coupled with each other. A selected diffusing sheet 131 may be placed on an upper portion of the diffusing body 132 and then, the sheet fixing cap 135 may be disposed on an upper portion of the diffusing sheet 131, such that the diffusing sheet 131 is held between the diffusing body 132 and the sheet fixing cap 135. In this instance, the coupling between the diffusing body 132 and the sheet fixing cap 135 may be a clamping coupling and the like, but examples of the structure of the coupling are not limited thereto.

Here, the diffusing sheet 131 is an element which directly diffuses and mixes light emitted from the LEDs 111, and may be a type of lens or may be a poly carbonate (PC) or a poly methyl methacrylate (PMMA)-based transparent plastic, glass, a semi-transparent plastic, or the like. The color of light emitted from the LED 111 may be converted by further including a fluorescent substance in a material of the diffusing sheet 131. Also, a brightness of the output light may be appropriately adjusted based on the type of the diffusing sheet 131 which is used.

As an example, a micro-pattern may be formed on at least one surface of the diffusing sheet 131. The micro-pattern may improve a light diffusion effect. In this example, the diffusing sheet 131 may be formed of a transparent material to which a diffusion material is not added, or may be formed of a transparent material to which a diffusion material is added.

As described in the foregoing, the LED lighting module 100 may be in a structure in which the LED array 110 and the diffusing portion 130 are detachably coupled with each other.

Accordingly, a plurality of first protrusions 116, protruding to an external direction, may be formed on the side wall 115 of the LED array 110, and a plurality of first insertion members 136, into which the plurality of first protrusions 116 are partially insertable, may be formed on a side wall of the diffusing body 132 of the diffusing portion 130.

The LED array 110 and the diffusing portion 130 may be placed in a position and coupled with each other, and the diffusing portion 130 may then be rotated in one direction with respect to the LED array 110, so that the diffusing portion 130 is coupled with the LED array 110. Also, dissembling may be readily performed in a reverse manner.

As illustrated in FIG. 5, the plurality of first protrusions 116 may be formed along a circumference of the side wall 115 of the LED array 110, at regular intervals. Although three first protrusions 116 are illustrated in FIG. 5, the number of first protrusions 116 is not be limited thereto. Also, the plurality of first protrusions 116 may not be disposed at regular intervals.

Three first insertion members 136 may be disposed at regular intervals along a circumference of the diffusing body 132 so as to correspond to the plurality of first protrusions 116. As illustrated in FIG. 4, the first insertion member 136 may be cut from a lower portion of the side wall of the diffusing body 132 in an upper direction, and may then be cut in a lateral direction, so as to guide the first protrusion 116.

That is, the diffusing portion 130 may be placed in a position on the LED array 110 and may be coupled with the LED array 110, so that the first protrusion 116 of the LED array 110 may be inserted into a portion 136*a* of the first insertion member 136 cut in an upper direction of the diffusing portion 130. Subsequently, when the diffusing portion 130 is rotated with respect to the LED array 110, the first protrusion 116 may be inserted into an internal side along with a portion 136*b* cut in a lateral direction of the first insertion member 136, and may be held there.

In this instance, to enable the first protrusion 116 to be smoothly inserted into the first insertion member 136, a bending portion 136*c* between the portion 136*a* cut in the upper direction of the first insertion member 136 and the portion 136*b* cut in the lateral direction may be rounded as illustrated in FIG. 4. Accordingly, the first protrusion 116 may be readily inserted into the most internal portion of the first insertion member 136 through the path of the first insertion member 136.

As illustrated in FIG. 4, a stopper 137, formed in a protruding shape, may be included in the most internal portion of the first insertion member 136. The stopper 137 may prevent the first protrusion 116 from arbitrarily leaving the first insertion member 136 when the first protrusion 116 is held in the first insertion member 136 based on coupling between the LED array 110 and the diffusing portion 130.

Accordingly, the LED array 110 and the diffusing portion 130 may be readily coupled to and separated from each other and thus, the LED array 110 may be utilized independently, or may be utilized by coupling with the diffusing portion 130.

The reflecting portion 150 may be detachably coupled with the diffusing portion 130, as illustrated in FIGS. 1 through 3, and thus, may reflect light that is emitted from the LED 111 and has been diffused and mixed by the diffusing portion 130.

The reflecting portion 150 may include a reflecting body 151, in the shape of a hollow cylinder which encloses at least an upper portion of the diffusing body 132, and may include a magnified body 155 to reflect light, of which a diameter is increasingly magnified from an upper portion of the reflecting body 151 to an end of the magnifying body 155.

The reflecting portion 150 may also have a structure that is detachably coupled with the defusing portion 130. In this example, a structure of a coupling between the reflecting portion 150 and the diffusing portion 130 may be simple and thus, coupling and detachment may be readily performed.

According to the structure of the coupling, a plurality of second protrusions 138, protruding to an external direction, may be formed on an external side wall of the diffusing body 132 of the diffusing portion 130, and a plurality of second insertion members 156, to which the plurality of second protrusions 138 is insertable, may be formed on a side wall of the reflecting body 151 of the reflecting portion 150. The configurations of the second protruding portions 138 and the second insertion members 156 may be substantially the same as those of the first protrusions 116 and the first insertion members 136 and thus, detailed descriptions thereof will be provided only roughly.

Similar to the structure of the coupling between the diffusing portion 130 and the LED array 110, the reflecting portion 150 may be placed in a position on the diffusing portion 130, and may then be coupled with the diffusing portion 130. In the coupling, the second protrusion 138 formed on the diffusing body 132 may be inserted into a portion of the second insertion member 156 cut in an upper direction of the reflecting body 151. Subsequently, when the reflecting portion 150 is rotated with respect to the diffusing portion 130, the second protrusions 138 may be inserted into an internal side along a portion cut in a lateral direction of the second insertion members 156, and may be held there.

In this instance, a bending portion in the internal structure of the second insertion members 156 may be rounded in the same manner as the internal structure of the first insertion members 136, and a stopper (not illustrated), which is substantially the same as the stopper 137, may be included at an internal end portion so as to prevent the second protrusions 138 from arbitrarily leaving the second insertion members 136.

Figure 6:
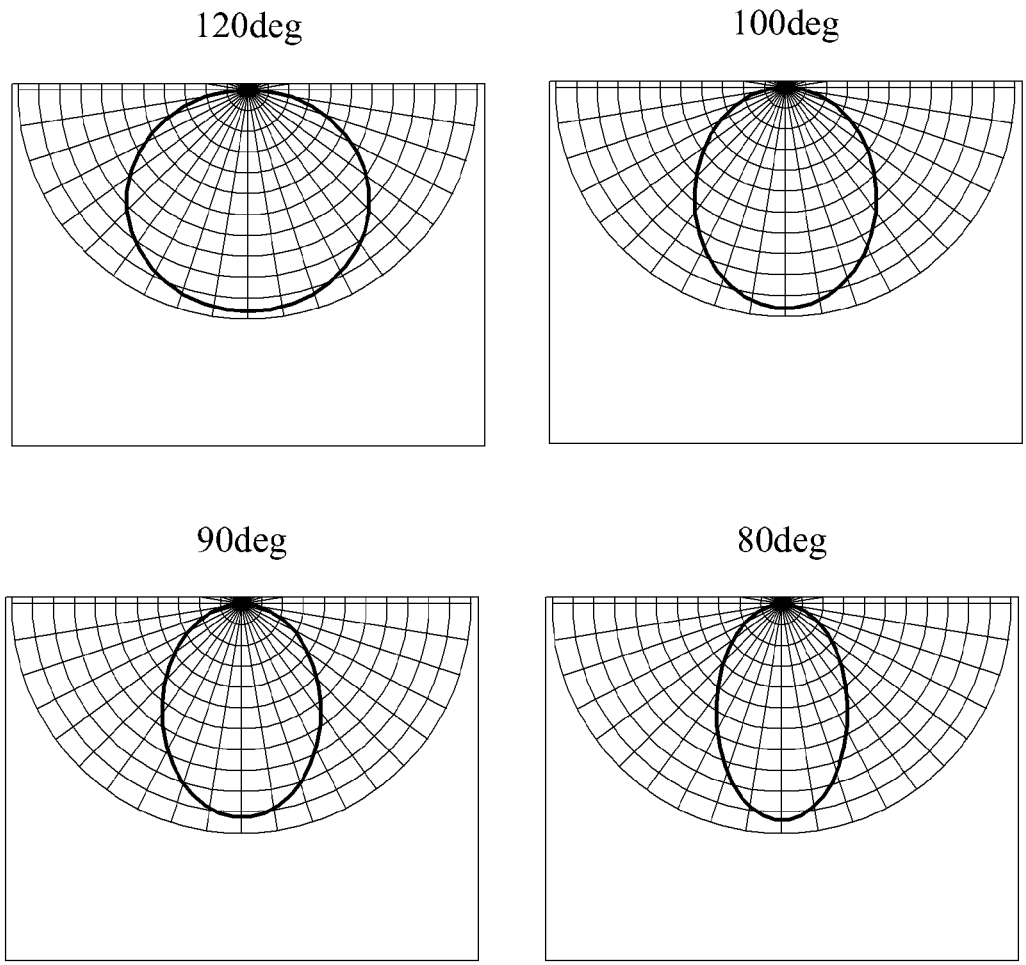
FIG. 6 is a diagram illustrating examples of a light distribution angle adjusted using the diffusing portion of FIG. 2.

FIG. 6 illustrates examples of a light distribution angle adjusted using the diffusing portion of FIG. 2. Referring to FIG. 6, the light distribution angle may be adjustable using the diffusing sheet 131 included in the diffusing portion 130.

The example in the top left corner of FIG. 6 shows a light distribution angle of 120 degrees when light is emitted merely through the LED array 110 without being coupled with the diffusing portion 130. The remaining examples of FIG. 6 show light distribution angles when the diffusing portion 130 and the LED array 110 are coupled with each other. The light distribution angle may be appropriately adjusted to 100 degrees, 90 degrees, 80 degrees, or the like, by properly selecting, from among a plurality of diffusing sheets, the diffusing sheet 131 to be coupled with the diffusing portion 130.

According to this exemplary embodiment, the LED array 110 and the diffusing portion 130 may be readily coupled to and separated from each other, and the diffusing sheet 131 included in the diffusing portion 130 may be appropriately selected and thus, the brightness of light, the light distribution angle, and the like may be appropriately adjusted.

Hereinafter, an LED lighting module according to another exemplary embodiment will be described, and portions substantially the same as the portion of the LED lighting module 100 of the previously-described exemplary embodiment will be omitted for conciseness.

Figure 7:
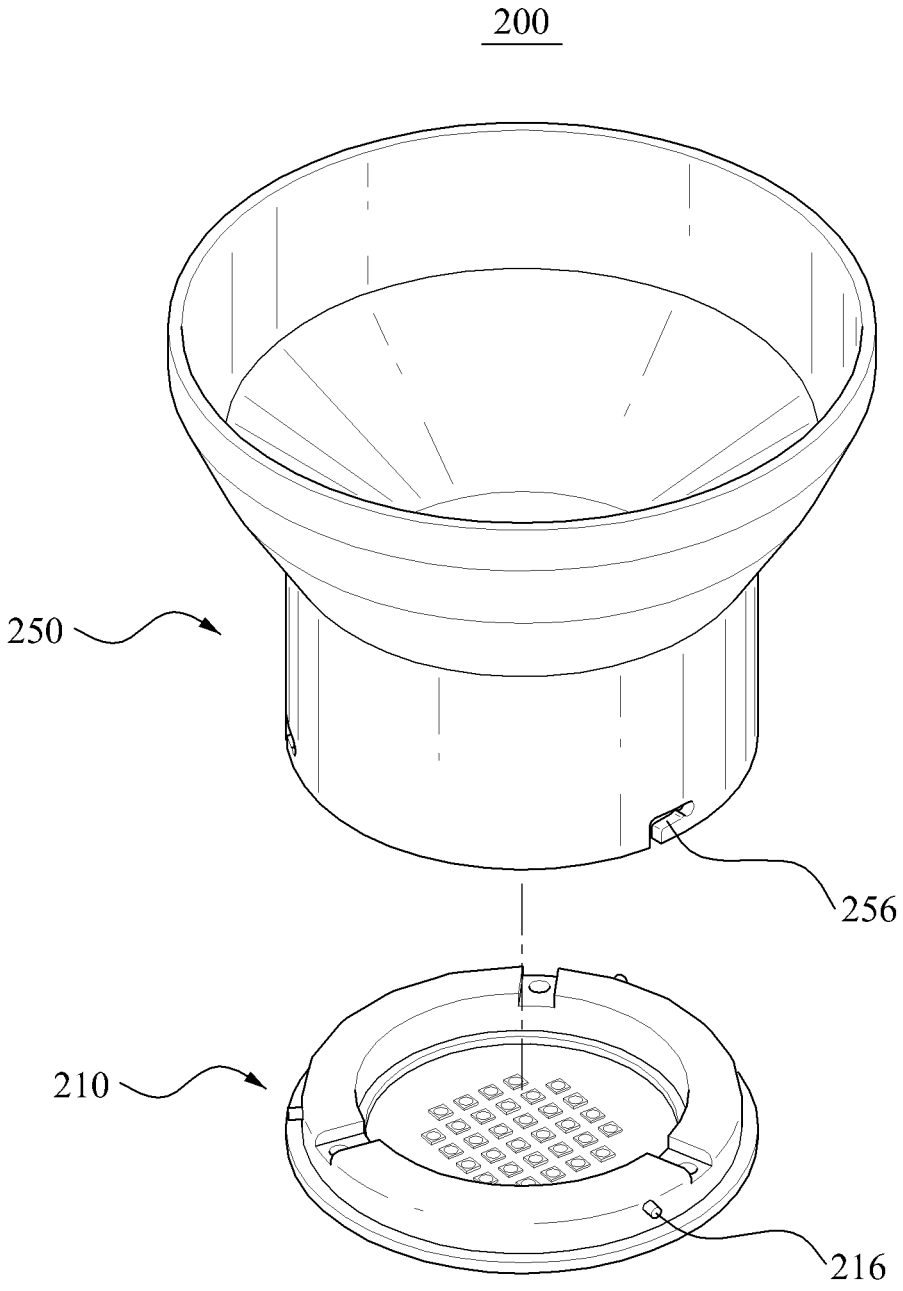
FIG. 7 is an exploded perspective view of an LED lighting module according to another exemplary embodiment.
Figure 8:
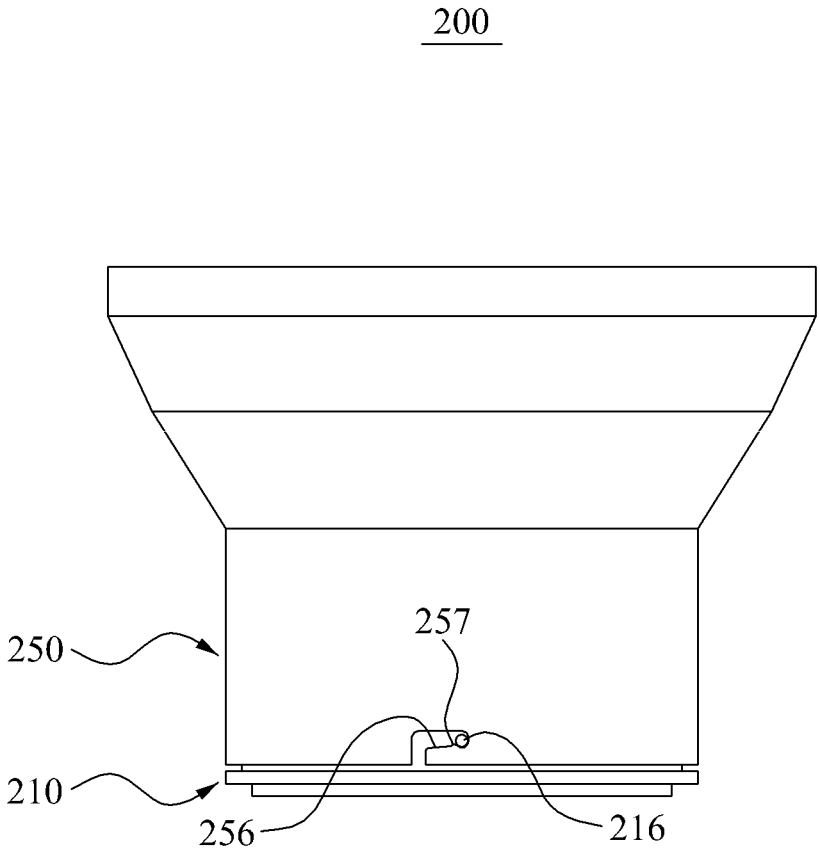
FIG. 8 is a front view of the LED lighting module of FIG. 7.

FIG. 7 illustrates an exploded perspective view of an LED lighting module 200 according to another exemplary embodiment, and FIG. 8 illustrates a front view of the LED lighting module 200 of FIG. 7.

Referring to FIGS. 7 and 8, the LED lighting module 200 includes an LED array 210 and a reflecting portion 250, which are substantially the same as the LED array 110 and the reflecting portion 150. However, the LED array 210 may be directly coupled with the reflecting portion 250 as a package structure, unlike the scheme in which an LED array is coupled with a diffusing portion and then a reflecting portion is coupled with the diffusing portion.

Accordingly, a light emitted from the LED array 210 may be directed by being passed through the reflecting portion 250.

A structure of a coupling between the LED array 210 and the reflecting portion 250 will be described based on the structure of the coupling between the LED array 110 and the diffusing portion 130 and the structure of the coupling between the diffusing portion 130 and the reflecting portion 150. A plurality of protrusions 216 may be formed on the LED array 210, and a plurality of insertion members 256 corresponding to the plurality of protrusions 216 may be formed on the reflecting portion 250.

Accordingly, as illustrated in FIGS. 7 and 8, the reflecting portion 250 may be placed in a position on the LED array 210 and may then be coupled with the LED array 210. The protrusion 216 equipped with the LED array 210 may be inserted into a portion of the insertion member 256 cut in an upper direction of the reflecting portion 250. Subsequently, when the reflecting portion 250 is rotated with respect to the LED array 210, the protrusion 216 may be inserted into an internal side along a portion cut in a lateral direction of the insertion member 256, and may be held there. In this instance, a bending portion of the insertion member 256 may be rounded to enable simple insertion of the protrusion 216 into the insertion member 256, and a stopper 257 may be included at an internal end portion of the insertion member 256 to prevent the protrusion 216 from arbitrarily leaving the insertion member 256.

As described in the foregoing, the reflecting portion 250, which directly reflects light without a diffusion portion, may be detachably coupled with the LED array 210. Accordingly, a light emitted from an LED 211 of the LED array 210 may be directly reflected.

A diffusing sheet (not illustrated) corresponding to the diffusing sheet 131 described in the foregoing may be coupled with the reflecting portion 250 to for diffusion of light.

Hereinafter, an LED lighting module according to still another exemplary embodiment will be described, and portions substantially the same as those described above with respect to the previously-described embodiments will be omitted for conciseness.

Figure 9:
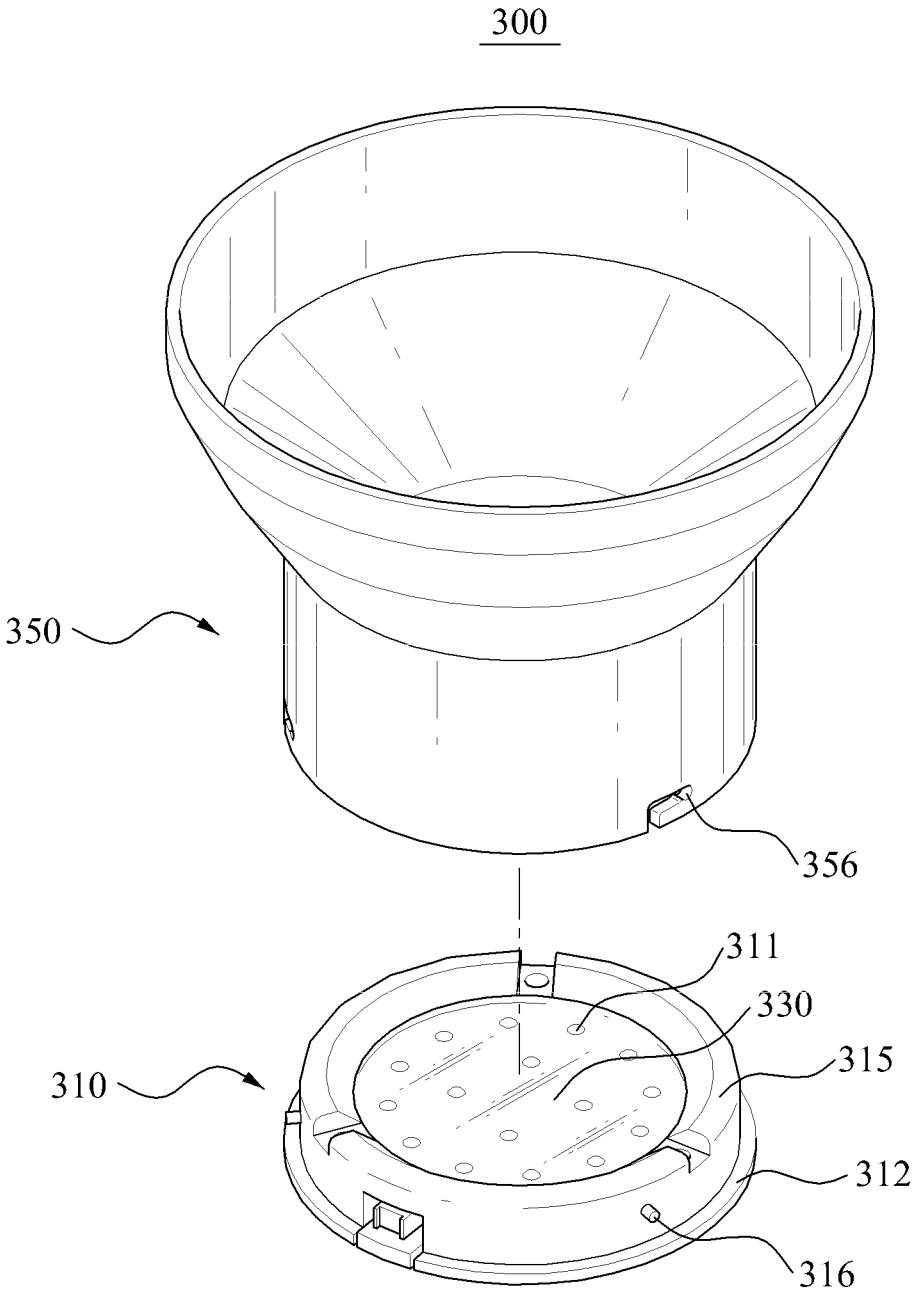
FIG. 9 is an exploded perspective view of an LED lighting module according to still another exemplary embodiment.
Figure 10:
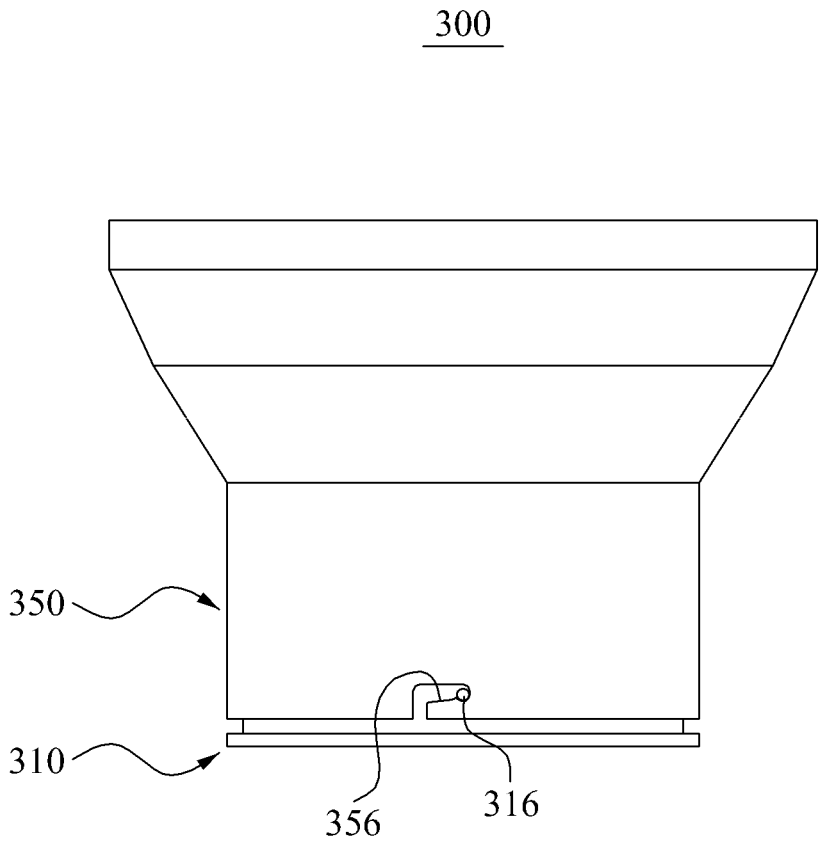
FIG. 10 is a front view of the LED lighting module of FIG. 9.

FIG. 9 illustrates an exploded perspective view of an LED lighting module 300 according to another exemplary embodiment, and FIG. 10 illustrates a front view of the LED lighting module 300 of FIG. 9.

Referring to FIGS. 9 and 10, the LED lighting module 300 may include an LED array 310 and a reflecting portion 350. The LED array 310 may include a plurality of LEDs 311 and a diffusing portion 330 for diffusing light emitted from the LEDs. The reflecting portion 350, detachably coupled with the LED array 310, may reflect light emitted from the LEDs 311. Although the reflecting portion 350 illustrated has an upper portion formed in the shape of a funnel, the shape of the reflecting portion 350 is not limited thereto.

The diffusing portion 330, that is, a lens-type diffusing sheet 330, may be integrated with the LED array 310. Accordingly, a structure of a coupling between the LED array 310 and the diffusing portion 330 may be simple, and light emitted from the LEDs 311 may be diffused and mixed, and may be emitted through the reflecting portion 350.

Referring to FIGS. 9 and 10, the LED array 310 may include a mounting plate 312 on which the plurality of LEDs 311 is mounted at regular intervals, and a sheet fixing member 315 that is detachably coupled with the mounting plate 312, and the diffusing portion 130 may be coupled with an opening of a sheet fixing member 315 that opens in one direction.

The diffusing portion 330 may be a lens-type diffusing sheet 330 and may be disposed at an internal side of the opening of the sheet fixing member 315. A position of the diffusing sheet 330 may be fixed by placing the diffusing sheet 330 between the mounting plate 312 and the sheet fixing member 315, and coupling them together.

The LED array 310 may have a structure that enables simple coupling and separation and thus, a user may appropriately select, from among a plurality of diffusing portions, the diffusing portion 330 that provides a desired light distribution angle. Here, a micro-pattern may be formed on the diffusing sheet 330, and the diffusing sheet 330 may be formed of a resin material filled with a diffusion material and a fluorescent substance. However, the material of the diffusing sheet 330, the pattern formed on an external surface, and the like are not limited thereto.

The LED array 310 and the reflecting portion 350 may be coupled in substantially the same way as the coupling structures of the previously-described embodiments. That is, a plurality of protrusions 316 may be formed on an external side surface of the sheet fixing member 315 of the LED array 310, and a plurality of insertion members 356 may be formed on the reflecting portion 350 corresponding to the plurality of protrusions 316.

Accordingly, the LED array 310 and the reflecting portion 350 may be coupled with each other. Subsequently, when the reflecting portion 350 is rotated with respect to the LED array 310, the protrusion 316 of the LED array 310 may be inserted into an internal side of the insertion member 356 of the reflecting portion 350 and may be held there.

Hereinafter, an LED lighting module according to yet another exemplary embodiment will be described, and portions substantially the same those described with respect to the LED lighting modules 100, 200, and 300 will be omitted for conciseness.

Figure 11:
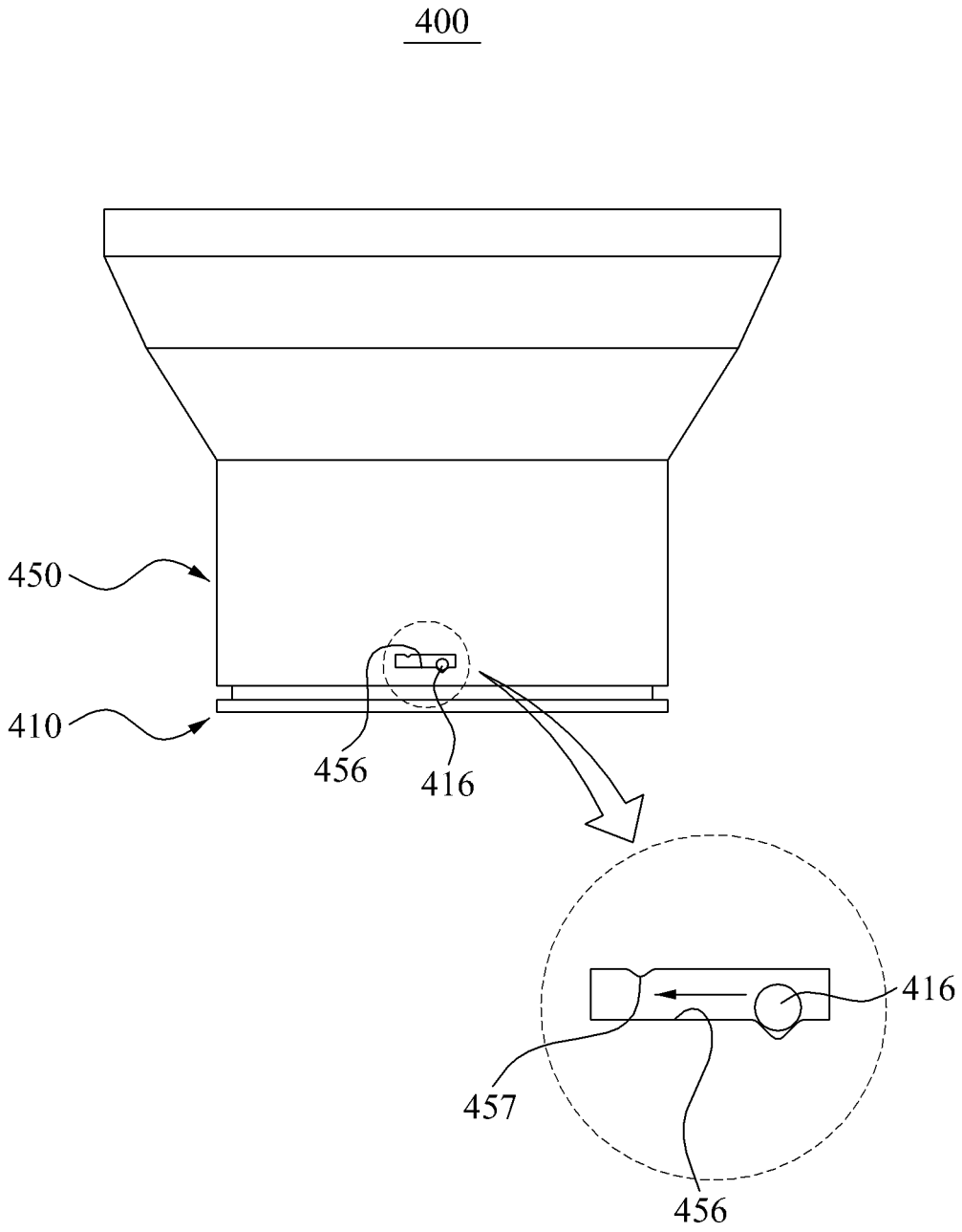
FIG. 11 is a front view of an LED lighting module according to yet another exemplary embodiment.

FIG. 11 illustrates a front view of an LED lighting module 400 according to yet another exemplary embodiment.

As illustrated in FIG. 11, the LED lighting module 400 may be substantially the same as the LED lighting module 300, but may have a different structure for coupling an LED array 410 to a reflecting portion 450.

The LED array 410 may be equipped with a protrusion 416, and a slot-type insertion member 456 may be formed on the reflecting portion 450.

That is, the insertion member 456 may be formed along a lateral direction of a side wall of the reflecting portion 450, and may be coupled with the insertion member 456 by forcibly inserting the protrusion 416 into the insertion member 456. In this instance, after the reflecting portion 450 is placed in the right position on the LED array 410, pressure is slightly applied to the reflecting portion 450 with respect to the LED array 410, and the protrusion 416 may be forcibly inserted into an internal side of the insertion member 456 for coupling.

Subsequently, when the reflecting portion 450 is rotated with respect to the LED array 410 in one direction, the protrusion 416 may be held by a stopper 457 of the insertion member 456.

Although the insertion member 456 formed on the reflecting portion 450 may be provided as a slot type, as shown in FIG. 11, the shape of the insertion member 456 is not limited thereto. Furthermore, the insertion member in other embodiments may also be provided as a slot type insertion member.

Also, a different type of coupling structure may be utilized in which the coupling structure has a simple structure and enables an insertion member and a protrusion to be detachably coupled toe each other.

Although a few exemplary embodiments have been shown and described, these embodiments are not limiting. Instead, it would be appreciated by those skilled in the art that changes may be made to these embodiments without departing from the principles and spirit of the inventive concept, the scope of which is defined by the claims and their equivalents.

What is claimed is:

1. A light emitting diode (LED) lighting module, comprising:

an LED array comprising at least one LED and a side wall which surrounds the at least one LED; and a light directing portion which is detachably coupled to the LED array, wherein the light directing portion comprises at least one of:

a diffusing portion comprising a diffusion plate which diffuses light emitted from the LED array; and a reflecting portion which reflects light emitted from the LED array, wherein the LED array comprises a plurality of first protrusions which are disposed on an external surface of the side wall and protrude outward from the side wall, and the light directing portion comprises a side wall and a plurality of first insertion members which are formed in the side wall of the light directing portion in locations corresponding to locations of the plurality of first protrusions.

2. The LED lighting module of claim 1, wherein the plurality of first protrusions are insertable into the plurality of first insertion member, such that the LED array and the light directing portion are detachably coupleable.

3. The LED lighting module of claim 2, wherein each of the first insertion members comprises an L-shaped slot cut in the side wall of the light directing portion, wherein the L-shaped slot comprises a vertical portion cut in an upward direction and a horizontal portion cut in a lateral direction.

4. The LED lighting module of claim 2, wherein the plurality of first protrusions are disposed at even intervals around the external surface of the side wall.

5. The LED lighting module of claim 2, wherein:

the light directing portion is a first light directing portion and comprises the diffusing portion, and the LED lighting module further comprises a second light directing portion comprising the reflecting portion;

the diffusing portion further comprises a plurality of second protrusions which are disposed on an external surface of the diffusing portion and which protrude outward from the external surface of the diffusing portion, and the reflecting portion further comprises a side wall and a plurality of second insertion members which are formed in the side wall of the reflecting portion in locations corresponding to locations of the plurality of first protrusions, wherein the plurality of second protrusions are insertable into the plurality of second insertion members, such that the diffusing portion and the reflecting portion are detachably coupleable.

6. The LED lighting module of claim 5, wherein each of the second insertion members comprises an L-shaped slot cut from the side wall of the reflecting portion, wherein the L-shaped slot comprises a vertical portion cut in an upward direction and a horizontal portion cut in a lateral direction.

7. The LED lighting module of claim 3, wherein a corner, where the vertical portion meets the lateral portion of the first insertion member, is rounded.

8. The LED lighting module of claim 6, wherein a corner, where the vertical portion meets the lateral portion of the second insertion member, is rounded.

9. The LED lighting module of claim 3, wherein a stopper protrudes from an internal side of the first insertion member, so as to prevent the first protrusion from arbitrarily leaving the first insertion member.

10. The LED lighting module of claim 6, wherein a stopper protrudes from an internal side of the second insertion member, so as to prevent the first protrusion or the second protrusion from arbitrarily leaving the second insertion member.

11. The LED lighting module of claim 5, wherein:

the first insertion member is a lateral slot formed in the sidewall of the diffusing portion and includes a stopper protruding from an internal end portion of the first insertion member to prevent the first protrusion from arbitrarily leaving the first insertion member; and the second insertion member is a lateral slot formed in the side wall of the reflecting portion and includes a stopper protruding from an internal end portion of the second insertion member to prevent the second protrusion from arbitrarily leaving the second insertion member.

12. The LED lighting module of claim 1, wherein:

the light directing portion comprises the diffusing portion, and the diffusing portion comprises a detachable diffusing sheet which changes a distribution angle of light emitted from the at least one LED.

13. The LED lighting module of claim 12, wherein the diffusing portion further comprises:

a diffusing body detachably coupled to the LED array; and a sheet fixing cap that fixes the diffusing sheet to an upper portion of the diffusing body, and is detachably coupled to the diffusing body.

14. The LED lighting module of claim 12, wherein the diffusing sheet is a lens and a micro pattern is formed on at least one surface of the lens, and the lens is formed of a resin material filled with a diffusion material and a fluorescent substance.

15. The LED lighting module of claim 1, wherein:

the light directing portion comprises the reflecting portion.

16. A light emitting diode (LED) lighting module, comprising:

an LED array comprising a plurality of LEDs and a diffusing portion which diffuses light emitted from the plurality of LEDs; and a reflecting portion, detachably coupled to the LED array, wherein the reflecting portion reflects light emitted from the plurality of LEDs, wherein the LED array comprises a plurality of first protrusions which are disposed on an external surface of a side wall and protrude outward from the side wall, the reflecting portion comprises a plurality of first insertion members formed in the reflecting portion at locations corresponding to locations of the plurality of first protrusions, and the plurality of first protrusions are insertable into the plurality of first insertion member such that the LED array and the reflecting portion are detachably coupleable.

17. The LED lighting module of claim 16, wherein the LED array comprises:

a mounting plate on which the plurality of LEDs are mounted at regular intervals; and a sheet fixing member detachably coupled to the mounting plate, wherein the sheet fixing member detachably holds the diffusing portion.

18. A light emitting diode (LED) lighting module comprising:

an LED array comprising an LED and a sidewall surrounding the LED;

a diffusing portion comprising a diffusing sheet and detachably coupled to the sidewall of the LED array, such that the diffusing sheet is disposed above the LED; and a reflecting portion comprising a reflector and detachably coupled to a sidewall of the diffusing portion, such that light transmitted through the diffusing sheet is reflected by the reflector, wherein the LED array comprises a plurality of first protrusions protruding outwardly from the sidewall of the LED array, the diffusing portion comprises a plurality of first insertion portions formed in a side wall at locations corresponding to locations of the plurality of first protrusions and a plurality of second protrusions protruding outwardly from the sidewall of the diffusing portion, and the reflecting portion comprises a plurality of second insertion members formed in the reflecting portion at locations corresponding to locations of the plurality of second protrusions.

19. The LED lighting module of claim 18, wherein the plurality of first protrusions are insertable into the plurality of first insertion portions such that the LED array and the diffusing portion are detachably coupleable, and the plurality of second protrusions are insertable into the plurality of second insertion portions such that the diffusing portion and the reflecting portion are detachably coupleable.

20. The LED lighting module of claim 18, wherein a light distribution angle of light emitted from the LED array without having passed through the diffusing portion and the reflecting portion is larger than a light distribution angle of light emitted from the LED array, having been transmitted through the diffusing portion and the reflecting portion.

* * * * *